United States Patent [19]

Lichtenberger

[11] 4,174,508

[45] Nov. 13, 1979

[54] RELAY LATCHING APPARATUS

[75] Inventor: William J. Lichtenberger, Murrysville, Pa.

[73] Assignee: Westinghouse Air Brake Company, Swissvale, Pa.

[21] Appl. No.: 904,641

[22] Filed: May 10, 1978

[51] Int. Cl.[2] ..... H01H 9/02

[52] U.S. Cl. ..... 335/202; 361/351

[58] Field of Search ..... 361/350, 357, 351, 426, 361/353, 360, 363, 376; 335/202, 278

[56] References Cited

U.S. PATENT DOCUMENTS

| | | | |
|---|---|---|---|
| 3,160,724 | 12/1964 | Depew | 335/202 X |
| 3,321,723 | 5/1967 | Chanowitz | 335/202 X |
| 3,887,259 | 6/1975 | Ayer | 361/426 X |
| 3,936,133 | 2/1976 | Splitt et al. | 361/426 X |

*Primary Examiner*—George Harris

*Attorney, Agent, or Firm*—J. B. Sotak; R. W. McIntire, Jr.

[57] ABSTRACT

A latching arrangement for a plug-in type of electromagnetic relay employing an insulative mounting sub-base for receiving an insulative relay base. An elongated leaf spring carried by the insulative mounting sub-base and having its ends protruding beyond the top and bottom of the insulative mounting sub-base. A pair of inclined ears formed on the insulative relay base for engaging the ends of the elongated leaf spring and locking the plug-in relay to the insulative mounting sub-base. A spring biased push rod for deflecting the elongated leaf spring for causing its ends to retract and disengage the inclined ears to permit the relay to be unplugged from the insulative mounting sub-base.

10 Claims, 5 Drawing Figures

RELAY LATCHING APPARATUS

FIELD OF THE INVENTION

This invention relates to a latching mechanism for an electrical relay and more particularly to a latching arrangement for a plug-in relay having an insulative relay base which may be attached to an insulative mounting sub-base and which may be positively locked together by a latching arrangement having an elongated leaf spring carried by the insulative mounting sub-base and having a pair of ears formed on the insulative relay base which engage the respective ends of the elongated leaf spring and which disengage the respective ends of the elongated leaf spring when a spring biased push rod is depressed to deflect the intermediate portion of the elongated leaf spring.

BACKGROUND OF THE INVENTION

The present invention finds particular utility in a class of electromagnetic relays called plug-in relays wherein external connections can be made by plugging the relay into a receptacle mounted on a panel board or racks and can be broken by unplugging it therefrom. Further, when the relays are mounted on the supporting racks they are relatively close together so that there is very little space between adjacent relays as they project forward from the panel. Generally, these plug-in relays are manufactured in protective casings which include a front cover member and a back relay base member. The cover member and base member enclose the electrical and magnetic components and protect them from the adverse conditions of the environment. In addition to dirt, dust, moisture and other foreign matter, a railroad environment is susceptible to extreme and excessive vibrations which tend to loosen joined parts and components. Thus, it is advisable to employ a locking or latching mechanism with plug-in relays to prevent the male terminal base from becoming disconnected from the female mounting sub-base which is carried by the supporting panel. While previous latching mechanism have been effectively utilized in plug-in relays for railroad installations, these latches were expensive to manufacture and assembled, were relatively bulky and used up premium space and were unduely complicated in construction and operation. Thus, it is desirable to provide an improved latching device which is relatively inexpensive and simple in construction. Further, it is highly advantageous in relays of reduced size to minimize the space requirements and the complexity of the latching mechanism.

OBJECTS OF THE INVENTION

Accordingly, it is an object of this invention to provide a new and improved latching arrangement for plug-in relays.

A further object of this invention is to provide a unique latching mechanism which utilizes a minimum number of parts yet securely latches the base member of an electromagnetic relay to a mounting sub-base member.

Another object of this invention is to provide a novel latching assembly which employs an elongated leaf spring having its respective ends engaging a pair of inclined ears for locking a relay base to a mounting sub-base.

Yet a further object of this invention is to provide an improved latching arrangement for positively locking a plug-in relay onto a mounting receptable.

Yet a further object of this invention is to provide a new latching device for an electrical relay which includes a plug-in base member carrying a plurality of electrical contact elements and an electromagnet and having a cover for enclosing the contact elements and electromagnet and having a latching arrangement for securely latching the plug-in base member to a mounting sub-base member.

Still a further object of this invention is to provide an improved latching mechanism employing a spring biased unlatching push rod and a deflectable leaf spring having its ends engaging a pair of locking lugs for positively retaining a relay base member with a mounting sub-base member.

Still another object of this invention is to provide a unique latching arrangement for plug-in relays having a mounting sub-base for receiving a relay base, a cover for enclosing the magnetic and electrical relay structure, a spring biased push rod having one end extending beyond the outer surface of the cover and having an intermediate portion passing along the side of the cover and having the other end communicating with an apertured slot formed in the relay base, an elongated leaf spring carried by said mounting sub-base and having its ends slightly protruding beyond the outer edges of the mounting sub-base, and a locking means formed on the relay base for engaging the ends of the elongated leaf spring for latching the relay base to the mounting sub-base when the relay base is plugged into the mounting sub-base.

An additional object of this invention is to provide an improved latching arrangement which is economical in cost, simple in construction, reliable in operation, durable in service, dependable in performance and efficient in use.

SUMMARY OF THE INVENTION

In accordance with the present invention, there is provided a unique latching arrangement for a plug-in relay. The plug-in relay includes an insulative relay supporting base having a plurality of elongated movable and stationary contact elements. An electromagnetic structure is securely attached to the front of the insulative supporting base. A plastic cover is slipped over the contact elements and electromagnet and forms a protective enclosure with the insulative base. The cover, a name plate and a handle are attached to the front of the electromagnetic structure by a pair of screws. A spring biased push rod passes through a hole in the name plate and has a finger button formed on the exterior end thereof. The intermediate portion of the spring biased push rod is situated in a channel formed on the outside of the cover. The other end of the spring biased push rod includes two ninety degree offset portions which fit into an apertured slot formed in the insulative supporting base. The male terminal portions of the contact elements are adapted to fit into female connectors which are carried by an insulative mounting sub-base. The insulative mounting sub-base is fixedly attached to the racks of a panel board. The insulative mounting sub-base includes a recessed channel extending from top to bottom thereof. An elongated leaf spring is situated in the recessed channel which includes a rectangular opening located near the top and bottom of the recessed channel to accommodate a pair of centering tabs which are punched out of the elongated leaf spring. An indexing plate is placed over the elongated leaf spring and is secured to the mounting sub-base to entrap and retain the elongated leaf spring in position. The upper and lower ends of the elongated leaf spring extend slightly beyond the top and bottom edges of the mount sub-base. Thus as the relay is plugged in the pair of inclined ears engage the respective exposed ends of the leaf spring. The inclined ears depress the contacting spring ends and bow the central portion of the elongated leaf spring. When the ends slide off of the inclined surface, the resiliency of the leaf spring causes the ends of the leaf spring to snap behind the ears to positively lock the plug-in relay to the insulative mounting sub-base. The relay may be unlocked or released by first depressing the finger button of the spring biased push rod. This depression causes the offset end of the push rod to move inwardly in the apertured slot so that the tip of the push rod enters a hole in the perforated indexing plate and contacts the intermediate portion of the elongated leaf spring. This causes the intermediate portion of the elongated leaf spring to become bowed and results in the retraction of the ends of the elongated leaf spring from behind the inclined ears. Thus, the relay is unlatched and may be separated from the mounting sub-base by simply pulling on the handle to unplug the male terminal portions from the female connectors. Thus, the relay may be quickly and easily plugged into and automatically latched onto the mounting sub-base and conversely may be readily and expeditiously unlatched and unplugged from the mounting sub-base without difficulty.

BRIEF DESCRIPTION OF THE DRAWINGS

The above-mentioned objects and other attendant features and advantages of the present invention will become more readily apparent from the following detailed description of a preferred embodiment when read with reference to and considered in conjunction with the accompanying drawings, which form part of this disclosure, in which.

DETAILED DESCRIPTION OF THE INVENTION

Figure 1:
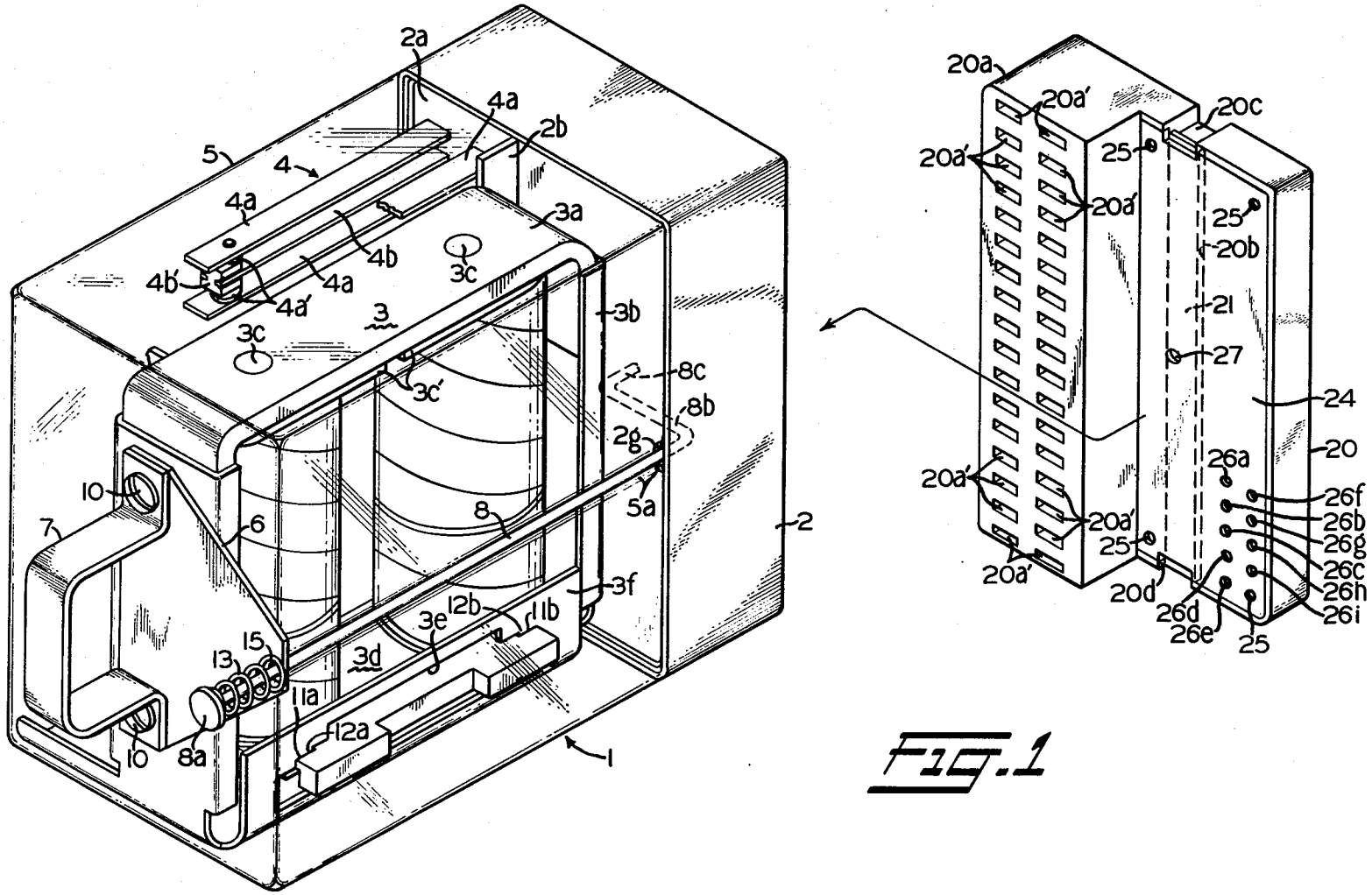
FIG. 1 is a perspective view of the vital type of plug-in relay detached from the mounting sub-base which is normally mounted to the rack of a panel board with certain parts broken away and omitted from the relay for the purpose of convenience.

Referring now to the drawings and in particular to FIG. 1, there is shown a plug-in relay, generally characterized by numeral 1, which is unplugged from its mounting sub-base which will be described in greater detail hereinafter. The vital plug-in relay 1 basically includes an insulative relay base 2, an electromagnetic structure 3, an electrical contact assembly 4, a protective cover 5, a name plate 6, a handle 7 and a latching arrangement including a push rod 8.

Figure 2:
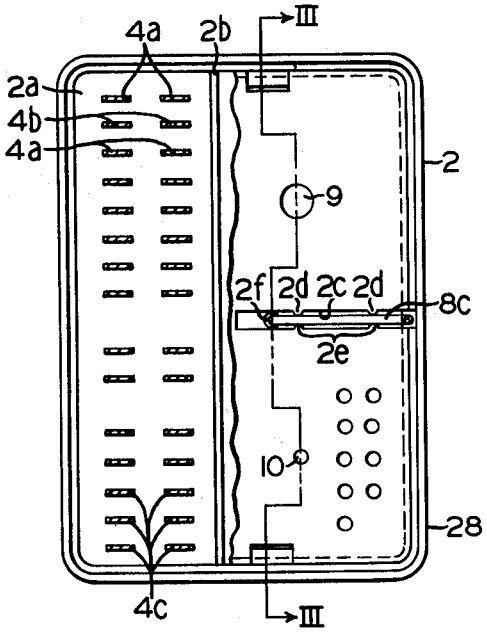
FIG. 2 is a front elevational view of the insulative relay mounting base and a portion of the push rod with the electrical contacts and a portion of the base broken away and with the handle, nameplate, cover and electromagnet omitted from the plug-in relay.

The relay supporting base member 2 is molded of suitable insulative material, such as, fiber glass filled resin, or the like, into a rectangular box-like member which has the necessary mechanical strength and the desired electrical insulative characteristics. The relay mounting base functions as a supporting means for the electrical contacts and the electromagnet as well as guiding and retaining means for the push rod. As shown in FIGS. 1 and 2, the relay mounting base includes a contact mounting block portion 2*a* which carries a plurality of movable and stationary spring contacts which are disposed in superimposed cooperative association with each other. The forward ends of the stationary front and back contacts 4*a* include a silver contact point 4*a*′ while the front end of the movable heel contact 4*b* includes a dual nonweldable contact point 4*b*′ which is disposed in cooperative relationship with the front and back contact points. Further, the bottom six conductive elements, namely, the lower three elements 4*c* in each row, are employed to provide electrical connections for the ends of the six coil leads of the three coil electromagnets. It will be appreciated that the front, back and heel contact springs 4*a* and 4*b* and six conductive elements are provided with rearwardly extending male terminal portions which are adapted to be plugged into female receiving connectors carried by a mounting sub-base which will be described in greater detail hereinafter. An insulative barrier partition 2*b* is situated between the contact assembly 4 and the electromagnet 3 to provide the necessary isolation between the two sub-components. As shown, the electro-magnetic structure 3 is mounted to the front of the relay base 2 by an appropriate bolt and screw which pass through holes 9 and 10, respectively, formed in the relay base 2. Thus, the thread portions of the bolt and screw are inserted in openings 9 and 10 and are screwed into tapped holes formed in the back side of C-shaped backstrap 3*a* and U-shaped metallic frame 3*b*. The electromagnet includes the backstrap member 3*a* to which is staked the upper ends of the magnetic cores 3*c* carrying a pair of bobbins and coils 3*c*′. The downwardly extending legs of the C-shaped backstrap member 3*a* and the upwardly extending legs of the U-shaped metallic frame 3*b* are secured by suitable fasteners, such as, flat head screws (not shown). In viewing FIG. 1, it will be noted that a flat spring biased pivotal armature member 3*d* has its rearward end inserted into a slot 3*e* formed in an upstanding portion 3*f* of the U-shaped frame 3*b*. In practice, an undercut slot 11*a* and 11*b* is formed on each side near the back end of the armature 3*d* which cooperates with entrapment portions 12*a* and 12*b* formed of the upstanding wall portion 3*f* so that a hinge coupling is created therebetween. Thus, the armature 3*d* is attracted upwardly when the electromagnet 3 is energized to open the back contacts and to close the front contacts. Conversely, when the electromagnet 3 is de-energized the biased armature 3*d* will release and will result in the opening of the front contacts and in the closing of the back contacts by the movable heel contacts 4*b*′.

Figure 3:
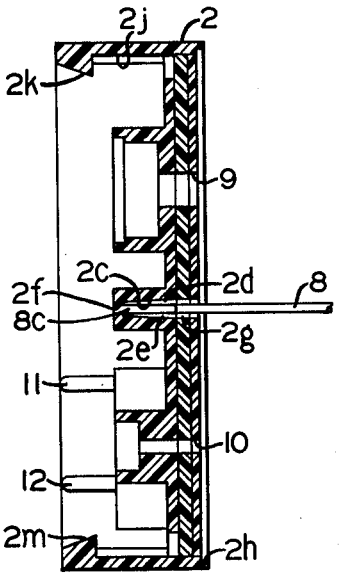
FIG. 3 is a side sectional view taken substantially along line III—III of FIG. 2.

After the attachment of the electromagnet 3 to the relay base 2, the elongated push rod 8 is the next element to be assembled in relation to the other element of the relay 1. Initially, a helical coil spring 13 is slipped onto the push rod 8 and is slid to the forward end which includes a finger button or knob 8a. Next, the push rod 8 is threaded through a hole 15 formed in the apex portion of the name plate 6. As shown, the rearward end of the push rod includes two ninety degree (90°) offset portions 8b and 8c. The rearward end is located in an apertured slot 2c formed laterally across the intermediate portion of the relay base 2. As shown in FIGS. 2 and 3, a pair of upper and lower ribs 2d and 2e are located in slot 2c to provide low frictional contact surfaces for engaging the lateral portion 8b of the push rod 8. The tip of offset portion 8c fits in a hole 2f formed in the backside of base 2. The push rod 8 freely passes through a semicircular hole 2g located at the right edge of the front face of the barrier and contact cover plate portions of the mounting base 2.

After the push rod 8 is situated in place, the molded plastic transparent cover 5 is slipped over the contact assembly and electromagnetic structure. The rear edge of cover 5 fits into a peripheral notch 2h formed around the front of insulative base 2. Thus, the cover 5 and the mating base 2 form a weather-tight enclosure which protects the operating parts from dust, dirt and other foreign substances. As shown in FIG. 1, the right side of the cover member 2 is provided with a channel or trough 2g for accommodating the intermediate portion of the push rod 8. The cover 5, the name plate 6 and the handle 7 each includes a pair of apertures or holes which are aligned with a pair of tapped holes formed in the front side of the electromagnet 3. Thus, a pair of machine screws 16 are screwed into the tapped holes and are tightened to securely hold the parts in proper relationship as shown in FIG. 1. Hence, the spring 13 is under compression and is trapped between the finger button 8a and the front side of the name plate 6 so that push rod 8 is biased outwardly away from the top of cover 5.

Figure 4:
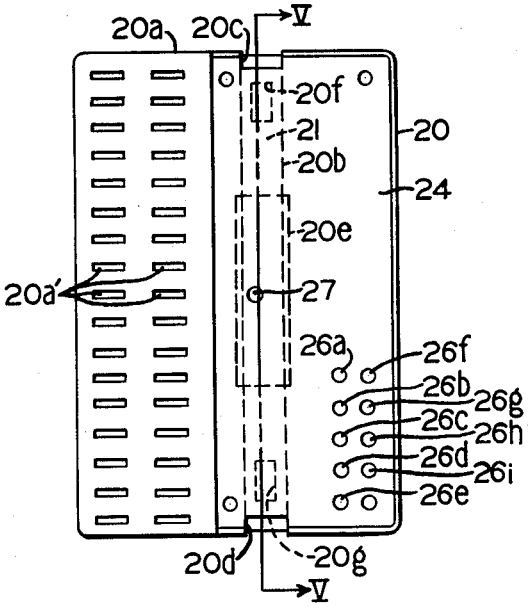
FIG. 4 is a front elevational view of the insulative mounting sub-base for the plug-in relay.
Figure 5:
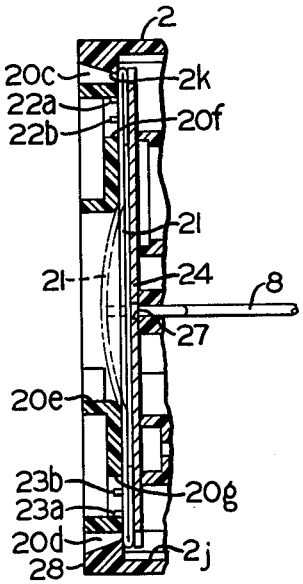
FIG. 5 is a side sectional view of the insulative mounting sub-base taken substantially along line V—V of FIG. 4 with a portion of the insulative relay base being shown in relation thereto.

In viewing FIGS. 3 and 5, it will be noted that the back of the relay base 2 is recessed or hollowed at 2j to receive the insulative sub-base member 20 which is mounted to the relay racks in the instrument casings or housing or to panel boards of the control apparatus. The mounting sub-base 20 is preferably molded on suitable insulative material, such as, fiber glass filled resin or the like, into a rectangular box-like member. As shown in FIG. 1, the left side of the rectangular sub-base 20 includes a raised portion 20a having two rows of orthogonal openings 20a' for accepting the male terminals of the fixed and stationary contacts as well as the coil energizing male terminals of the relay 1. The openings 20a' are adapted to accommodate suitable female connectors which are hard wired to appropriate external circuits which are to be controlled by the relay 1. As shown in FIG. 4, a recessed channel or trough 20b is formed in the front intermediate portion of the insulative mounting sub-base 20. The recessed channel 20b extends from the top to the bottom of the front surface of sub-base 20 and starts at an upper notch 20c removed from the top edge of sub-base 20 and ends at a lower notch 20d formed on the bottom edge of sub-base 20. The upper and lower notches 20c and 20d are aligned with and are adapted to accept an upper and lower inclined inwardly depending ears 2k and 2m formed on the upper and lower inner surfaces of recess 2j of base 2. In viewing FIGS. 4 and 5, it will be seen that a rectangular thru opening 20e is formed in the middle of the sub-base 2. Further, an upper rectangular opening 20f and a lower rectangular opening 20g are centrally located in the area of the recessed channel 20b. In practice, a flat elongated leaf spring 21 is placed into the recessed slot 20b with the ends or tips protruding slightly beyond the upper and lower notches 20c and 20d as shown in FIGS. 4 and 5. As shown in FIG. 5, the ends of the leaf spring 21 are turned back upon themselves to strengthen them. After the ends of the leaf spring are bent back they may be soldered or welded to add to their rigidness and sturdiness. The spring 21 is made of resilient metal, such as, beryllium copper, which may be repeatedly bent or deflected but will return to its original shape due to its pliancy and resiliency. As shown in FIG. 5, a pair of top knock-out tabs 22a and 22b are punched out of the upper middle section of the beryllium copper spring 21, and a similar pair of bottom knock-out tabs 23a and 23b are punched out of the lower middle section of the spring 21. The tabs 22a and 22b fit into the rectangular opening 20f while tabs 23a and 23b fit into the rectangular opening 20g. The tab 22a engages the upper surface of opening 20f while the tab 23a engages the lower surface of opening 20g to center the spring 22 in the slot 20b when it is in its extended or normal position as shown in full lines in FIG. 5. The leaf spring 21 and right side of the sub-base 20 is covered by an indexing plate 24 which is held in place by four screws threaded into the tapped holes 25 located in the respective corners. The indexing plate 24 includes two columns of circular holes 26a–i into which preselected indexing pins, such as, pins 11 and 12, of the appropriate relay may be inserted. The indexing arrangement is employed to prevent the installation of another relay not having the exact characteristics of the original relay 1 by plugging all the indexing holes except 26a and 26d. The indexing plate 24 also has a thru hole 27 formed in it intermediately between the top and bottom edge overlying the middle of the leaf spring 21 which rests over the rectangular aperture 20e.

Let us now assume that the relay 1 is completely assembled, that the sub-base 2 is fixedly mounted to the panel or rack, and that a maintainer or installer wishes to plug the relay 1 into the sub-base 20. The individual merely grasps the handle 7 and aligns the box recess 2j of relay base 2 with the outer perimeter of the box-like sub-base 20. This will result in the alignment of the electrical male terminal portions with the female connectors and also in the lining up of the indexing pins 11 and 12 with the unplugged indexing holes 26 so that relay 1 may be pushed unto sub-base 20 by applying force to handle 7. It will be appreciated that as the relay 1 is pushed onto the sub-base 20, the inclined ears 2k and 2m force the tips of the latching spring 21 inwardly and results in the bending of its intermediate portion as shown in phantom in FIG. 5. When the tips of the deflected spring 21 reach the end of the inclined surfaces, they are snapped back behind the ears 2k and 2m to positively lock the relay 1 onto the sub-base 20 as illustrated by the full lines in FIG. 5. Thus, the front, back and heel contacts are appropriately connected to the external electrical circuits, and vibrations or accidental bumping of the relay case will not loosen the electrical connections because of the positive latching of the ends of the spring 21 with the inclined ears 2k and 2m.

Let us know assume that a maintainer or inspector desires to unplug the relay 1 for inspection, maintenance or replacement purposes. The individual simply depresses the spring biased push rod button 8a so that the lateral portion 8b easily slides inwardly along ribs 2d and 2e and causes the tip of the offset portion to enter hole 27 in the indexing plate 24. As the tip of offset portion 8c moves forward, it engages the intermediate portion of spring 21 and causes it to become deflected or bent as shown in phantom in FIG. 5. The deflection of the spring 21 by the tip of the push rod 8 causes the ends of the spring 21 to become retracted from behind the ears 2k and 2m so that the relay 1 is effectively unlatched. It will be appreciated that the amount of retraction is limited by the tabs 22b and 23b which engage the lower face of hole 20f and the upper face of hole 20g, respectively, which also function as centering means for ensuring that the tips are retracted an equal amount when the spring 21 is deflected by the tip of the push rod or by the inclined surfaces of ears 2k and 2m. While depressing the finger button 8a, the individual simply pulls on the handle 7 to unplug the relay 1 from the sub-base 20 to break the electrical connection with the external circuits. Thus, the relay 1 may be readily plugged and latched onto the mounting sub-base 2 and also may be quickly unlatched and unplugged from the sub-base with a minimum of effort and time and without the need of ancillary equipment or tools. Hence, the unique latching arrangement has the advantage of easy attachment and detachment of a plug-in relay to a mounted sub-base.

It will be appreciated that while the present invention finds particular utility in plug-in electromagnetic relays, it is readily understood that the subject latching arrangement may be used in other types of relays and the like. Further, it is understood that regardless of the manner in which the invention is used, it is apparent that various changes and modifications may be made by persons skilled in the art without departing from the spirit and scope of the invention. For example, the tips of spring 21 may be reinforced by having separate pieces of metal attached thereto rather than having the ends turned back upon themselves and soldered thereto. The shape and length of the push rod 8 may be varied and may pass internally through the cover 5 rather than along the outside thereof. Other slight modifications may also be made, and therefore, it will be evident that all variations, alterations and equivalents falling within the bounds of the present invention are herein meant to be included in the appended claims.

Having thus described the invention, what I claim as new and desire to secure by Letters Patent, is:

1. A latching arrangement for plug-in relays comprising, a mounting sub-base for receiving a relay base, a cover for enclosing the magnetic and electrical relay structure, a spring biased push rod having one end extending beyond the outer surface of said cover and having an intermediate portion passing along the side of said cover and having the other end communicating with an apertured slot formed in said relay base, an elongated leaf spring carried by said mounting sub-base and having its ends slightly protruding beyond the outer edges of said mounting sub-base, and locking means formed on said relay base for engaging the ends of said elongated leaf spring for latching said relay base to said mounting sub-base when the relay base is plugged into said mounting sub-base.

2. The latching arrangement for a plug-in relay as defined in claim 1 wherein said elongated leaf spring is situated in a recessed channel formed in said mounting sub-base which permits the ends to be retracted when the leaf spring member is deflected by depressing said one end of said spring biased push rod.

3. The latching arrangement for a plug-in relay as defined in claim 1, wherein said locking means includes a pair of inwardly projecting ears.

4. The latching arrangement for a plug-in relay as defined in claim 2, wherein said elongated leaf spring includes restraining tabs which center and cause the ends of the elongated leaf spring to equally retract and protrude beyond the outer edges of said mounting sub-base.

5. The latching arrangement for a plug-in relay as defined in claim 2, wherein said elongated leaf spring is confined to said recessed channel by an indexing plate which is attached to said mounting sub-base.

6. The latching arrangement for a plug-in relay as defined in claim 1, wherein said mounting sub-base is a molded body of insulative material.

7. The latching arrangement for a plug-in relay as defined in claim 1, wherein said recessed base is molded of plastic insulative material.

8. The latching arrangement for a plug-in relay as defined in claim 1, wherein a handle and a plate are secured to the front of said cover, and said plate includes a hole for accommodating said one end of said latch rod extending beyond the outer surface of said cover, and a helical spring confined between said plate and a push button located at the outer extremity of said one end of said latch rod.

9. The latching arrangement for a plug-in relay as defined in claim 7, wherein said helical spring outwardly biases said latch rod so that said elongated leaf spring normally has its ends protruding beyond the top and bottom edges of said mounting sub-base and requires the depression of said push button for deflecting said elongated leaf spring by engagement of said other end of said latch rod for unlocking said mounting sub-base with said recessed base.

10. The latching arrangement for a plug-in relay as defined in claim 3, wherein each of said inwardly projecting ears include an inclined surface over which the ends of said elongated leaf spring slide for locking said mounting sub-base to said recess base.

* * * * *